US005979345A

United States Patent [19]

Price et al.

[11] Patent Number: 5,979,345

[45] Date of Patent: Nov. 9, 1999

[54] SPINDLE TENSION SYSTEM FOR SEWING STATION

[75] Inventors: Elvin C. Price, Dacula; Preston B. Dasher; John S. Chamlee, both of Lawrenceville; Tadeusz Olewicz, Hoschton, all of Ga.

[73] Assignee: Atlanta Attachment Company, Lawerenceville, Ga.

[21] Appl. No.: 08/914,074

[22] Filed: Aug. 18, 1997

Related U.S. Application Data

[63] Continuation-in-part of application No. 08/548,585, Oct. 26, 1995, Pat. No. 5,657,711, which is a continuation-in-part of application No. 08/503,518, Jul. 18, 1995, Pat. No. 5,562,060, which is a continuation-in-part of application No. 08/311,921, Sep. 26, 1994, Pat. No. 5,522,332, which is a continuation-in-part of application No. 08/131,131, Oct. 4, 1993, Pat. No. 5,437,238.

[51] Int. Cl.[6] ..... D05B 35/04

[52] U.S. Cl. ..... 112/470.29; 112/475.09

[58] Field of Search ..... 112/470.29, 306, 112/308, 475.02, 470.33, 475.13, 475.09

[56] References Cited

U.S. PATENT DOCUMENTS

| | | | |
|---|---|---|---|
| 4,046,087 | 9/1977 | Manetti | 112/121.15 |
| 4,053,967 | 10/1977 | Mair | 26/98 |
| 4,265,187 | 5/1981 | Torre | 112/121.26 |
| 4,473,017 | 9/1984 | Letard et al. | 112/141 |
| 4,484,532 | 11/1984 | Norz | 112/2 |
| 4,928,610 | 5/1990 | Akutsu | 112/153 |
| 4,947,771 | 8/1990 | Miyachi et al. | 112/470.29 X |
| 5,131,336 | 7/1992 | Kono et al. | 112/470.29 |
| 5,251,557 | 10/1993 | Rohr | 112/306 |
| 5,269,239 | 12/1993 | Adamski, Jr. et al. | 112/121.27 |
| 5,269,257 | 12/1993 | Yamazaki | 112/262.2 |
| 5,437,238 | 8/1995 | Price et al. | 112/470.29 |
| 5,522,332 | 6/1996 | Price et al. | 112/470.29 |
| 5,562,060 | 10/1996 | Price et al. | 112/470.29 |
| 5,657,711 | 8/1997 | Price et al. | 112/470.33 |

FOREIGN PATENT DOCUMENTS

| | | |
|---|---|---|
| 58-11471 | 1/1983 | Japan . |

*Primary Examiner*—Ismael Izaguirre

*Attorney, Agent, or Firm*—Womble Carlyle Sandridge & Rice

[57] ABSTRACT

A sewing system (10) includes a tension adjustment spindle assembly (30) constructed and arranged to move a spindle (26) laterally toward and away from a sewing head (16) of the sewing machine to adjust the tension in the looped end of a work piece (28). A tension roller (70) engages a bottom run (29) of the work piece (28), so that when proper tension is applied to the work piece at the beginning of the cycle of operation by the lateral shifting of the tension adjustment spindle assembly (30), a proximity switch (88) detects the upward movement of a tension arm (72) and initiates the operation of the sewing system. As the sewing system operates and the work piece tends to become longer because of the penetration of the needles and the insertion of stitches between the yarns of the work piece, and temporary stretching associated with the handling of the work piece, the tension roller (70) moves downwardly into the lower run of the work piece to constantly apply a predetermined downward tension force against the bottom run of the work piece to maintain a constant tension force on the work piece.

8 Claims, 2 Drawing Sheets

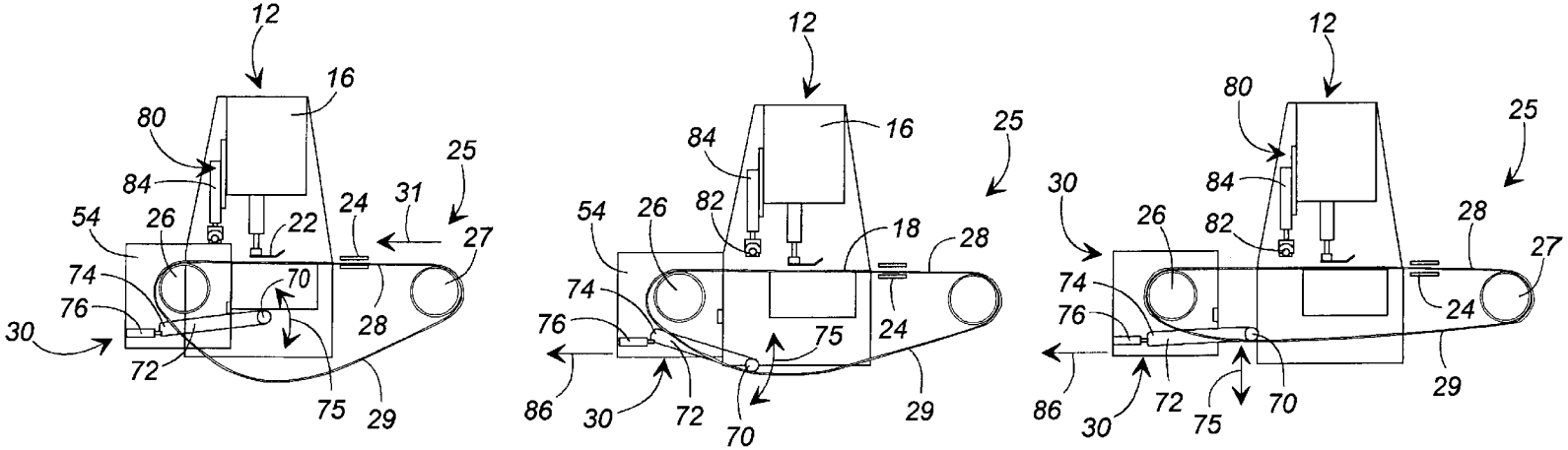
FIG. 2
FIG. 3
FIG. 4
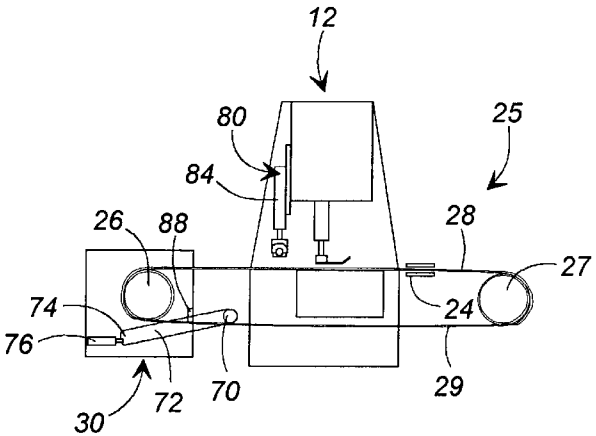
FIG. 5
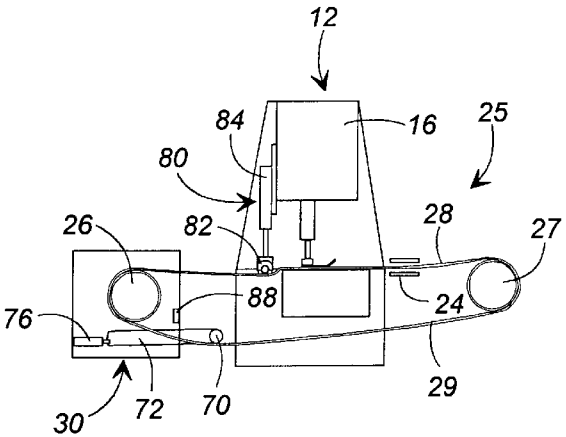
FIG. 6

SPINDLE TENSION SYSTEM FOR SEWING STATION

CROSS REFERENCE TO RELATED APPLICATIONS

This is a continuation-in-part of U.S. patent application Ser. No. 08/548,585, filed Oct. 26, 1995, now U.S. Pat. No. 5,657,711, which is a continuation-in-part of U.S. patent application Ser. No. 08/503,518, filed Jul. 18, 1995, now U.S. Pat. No. 5,562,060, which is a continuation-in-part of U.S. patent application Ser. No. 08/311,921, filed Sep. 26, 1994, now U.S. Pat. No. 5,522,332, which is a continuation-in-part of U.S. patent application Ser. No. 08/131,131, filed Oct. 4, 1993, now U.S. Pat. No. 5,437,238.

FIELD OF THE INVENTION

This invention relates to a control system for advancing the continuous edge of a tubular textile work piece through a finishing station, such as a sewing machine, at which a hem is sewn into the work piece. More particularly, the invention relates to the provision of a tension control apparatus which maintains a constant and predetermined tension force applied to a tubular textile work piece looped over a spaced pair of spindles as the edge of the work piece is advanced through the sewing machine on the spindles by the automatic adjustment of a tension arm and a tension cylinder which position a rotatable tension roller on the return run of the looped work piece during a cycle of the operation of the sewing system to maintain a constant tension in the workpiece during the cycle of operation.

BACKGROUND OF THE INVENTION

When garments are produced in an industrial setting in which large numbers of garment parts are delivered to work stations where the garment parts are folded and/or assembled and sewn together, it is important that the equipment provided to the worker be fast and accurate in its operation, and that the equipment be constructed and function so that the operator can expediently and easily load the equipment with the garment parts. Also, it is desirable that once the garment parts have been properly placed in position by the worker on the equipment and the equipment is placed in operation that the equipment not only perform the normal sewing functions on the garment parts, but that the sewing functions be performed accurately and rapidly without developing flaws in the work pieces. Moreover, it is desirable that the equipment run independently, i.e., it is automated, so that after the sewing cycle of the equipment begins the machine operator is now allowed to operate two or more similar pieces of equipment at one time by alternately loading the first machine, and as the first machine functions to complete its cycle of operation, to turn and load an adjacent machine.

During the normal sewing function of the continuous edge of a looped end textile work piece, as when forming a hem in the continuous waist edge of a knitted shirt, for example a T-shirt or knit sport shirt, the edge of the work piece is placed in tension, usually by placing the edge portion of the work piece about a pair of spaced guide spindles that rotate and advance the edge portion through the sewing station. At the beginning of the sewing cycle the guide spindles move away from each other so as to lightly stretch, or tension, the edge portion of the work piece, and upon the work piece becoming stretched to a given tension, the cycle of operation of the sewing system begins. Expandable spindle assemblies of this type are disclosed in U.S. Pat. Nos. 4,046,087; 5,437,238; 5,562,060; 5,570,648; 5,522,332; and U.S. patent application Ser. Nos. 08/556,707 and 08/548,585.

The initial tension applied to the work piece by the spindles is selected so as to create the optimum conditions for the sewing function, and the desired conditions are compatible with the work piece and with the operation of the equipment. For example, some textile work pieces might become excessively elongated or might develop excessive curl at the edge of the hem if overstretched. Therefore, the initial tension applied to the work piece usually will be matched with the characteristics of the work piece.

As the sewing machine operates to insert stitches in the textile work piece, for example, while sewing a hem therein, both the needles and the threads which penetrate the work piece move in between, or sometimes even destroy, the yarns of the work piece which tends to move or spread the yarns further apart from one another and thus causes the work piece to progressively lengthen or "grow" during the sewing operation. Additional "growth" in the work piece can be attributed to temporary stretching of the work piece as it travels through a folding guide, if one is provided, and any additional guides provided as a part of the machine. As the product begins to grow, the tension of the work piece as initially applied by the guide spindles of the equipment usually decreases. Unless some adjustment is made to maintain the desired tension in the work piece, as the reduced tension might cause a malfunction in the sewing operation and a flaw in the work piece.

The prior art structures typically have utilized movable spindles for the purpose of accommodating different sized work pieces, so that the spindles could be expanded farther apart to apply proper tension to the larger size garments, yet could be moved closer together to accommodate the smaller size garments. Since the movable spindle concept was well known, the prior art systems have also utilized movable spindles to adjust the tension of the work piece during the cycle of operation of the sewing machine, typically by moving the spindles progressively farther apart during the sewing cycle to maintain the tension in the work piece as the work piece grows.

While the progressive movement of the spindles during the sewing operation can adjust the tension in the work piece, a spindle typically has a relatively large mass and its movement in small increments is difficult to accurately control. When the system attempts to move a spindle, it first must overcome the static friction of the spindle support system, and once this is overcome, the spindle typically is moved in a short surge of movement before its movement can be stopped. Since the work piece is usually looped about the movable spindle, the movement of the spindle results in movement, stretching, of both the upper and lower runs of the work piece, thereby effectively doubling the length of the movement of the work piece for a given movement of the spindle. This intermittent movement tends to continually overstretch, or tension, and then release the work piece.

Therefore, it can be seen that it would be desirable to provide a spindle assembly for a sewing machine which would include the advantages of the types of assemblies described above, but which would further include the ability to automatically maintain a constant tension in the workpiece during the entirety of the sewing operation for maintaining positive control over the workpiece to ensure that a uniform hem, for example, is sewn in each workpiece so processed during the cycles of operation of the sewing machine, without otherwise overstretching or understretching the work piece.

It is desirable for the movable spindle system to be constructed to allow at least one of the work piece handling spindles to be moved closely adjacent the sewing head and work platform so as to accept even the smallest sizes of the work piece, so that small sized work pieces can be manufactured on the sewing system. In some instances, the levers and other elements associated with the movable spindle or spindles form an obstruction to the movement of the spindle or spindles while it is, or they are, respectively, in close proximity to the head of the sewing machine. If the movable spindle(s) cannot move close to the sewing machine, additional stretching of the smaller size garments might be required as they are loaded onto the guide spindles, resulting in extra effort required by the machine operator to accomplish this task, and may possibly result in the overstretching of the work piece.

SUMMARY OF THE INVENTION

Briefly described, the present invention comprises a spindle tension system for a sewing station which includes a pair of spaced spindles that straddle the sewing machine and which each respectively receive one of the two looped ends of a tubular preformed textile work piece in a configuration where the work piece extends across a work surface of the sewing machine and beneath the needles and presser foot of the sewing machine. One of the spindles is a tension adjustment spindle for adjusting the tension of the work piece. The tension adjustment spindle is movably mounted to a spindle support, and a spindle position shifter is interconnected with the tension adjustment spindle and its spindle support and is arranged to move the tension adjustment spindle at the beginning of the cycle of operation of the sewing machine in a direction to apply a predetermined initial tension to the work piece during the beginning of the cycle of operation of the sewing machine. A tension controller is associated with the tension adjustment spindle, and includes a pivotable tension arm having a tension roller rotatably supported at the distal end of the tension arm, with the tension controller, to include the tension roller, being constructed arranged to lightly engage the finished edge portion of the work piece on its return run or passage toward the spaced idler spindle for applying a constant and predetermined tension force to the workpiece to maintain a relatively constant tension in the workpiece over and about the two spindles, which provides for more accurate, and thus precise, control of the finished edge of the work piece, as well as control over the balance of the workpiece during the sewing system cycle of operation. The position of the tension arm may also be used as a tension indicator for the tension adjustment spindle, as the tension arm is constructed and arranged to move in response to the change in tension of the work piece which occurs as the adjustment spindle is moved toward and away from the idler spindle.

Thus, it is an object of this invention to provide an improved spindle assembly for a sewing machine which advances a looped end textile work piece through the sewing machine, and which progressively adjusts its position so as to apply a predetermined and continuous tension force to the work piece during a cycle of operation of the sewing machine.

Another object of this invention is to provide an improved method and apparatus for forming a uniform hem in a looped end textile work piece.

Another object of this invention is to provide an improved method and apparatus for applying constant tension to a looped end textile work piece as the work piece is advanced along a processing path through a sewing machine.

Other objects, features and advantages of the present invention will become apparent upon reading the following specifications, when taken in conjunction with the accompanying drawings.

BRIEF DESCRIPTION OF THE DRAWINGS

FIGS. 2–6 are sequential and schematic front elevational views of the sewing machine and the tension adjustment spindle assembly of FIG. 1 showing the progressive operation of the spindle assembly during a sewing system cycle of operation.

DETAILED DESCRIPTION

Figure 1:
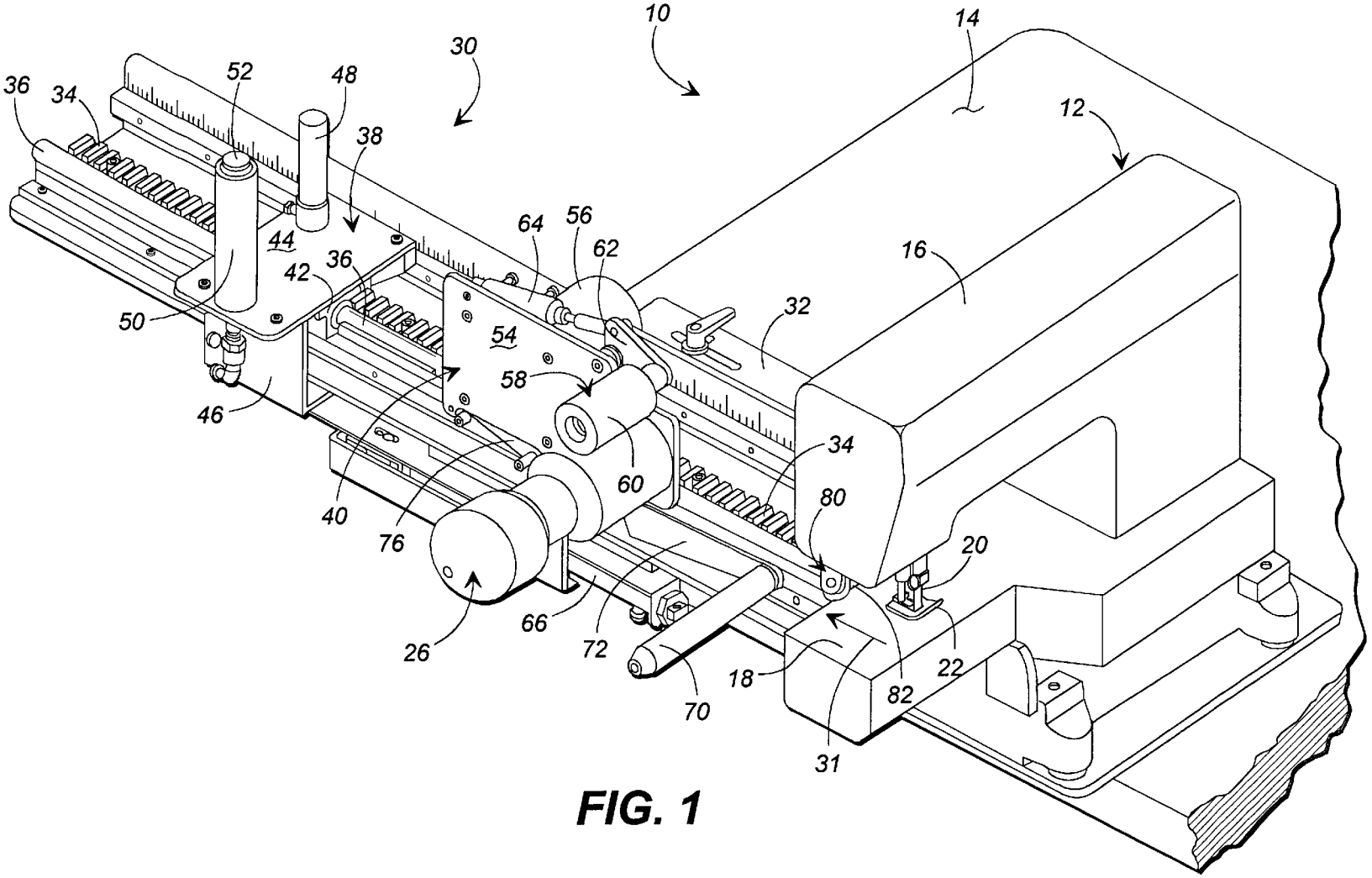
FIG. 1 is a front perspective illustration of a sewing machine and of a preferred embodiment of a tension adjustment spindle assembly for use with the sewing machine.

Referring now in more detail to the drawings, in which like reference numerals indicate like parts throughout the several views, FIG. 1 illustrates a sewing system 10 that includes a sewing machine 12 of standard design mounted on a work platform 14, with the sewing machine including the sewing head 16, the horizontal work surface 18 over which the textile work pieces will pass, the sewing needles 20 and presser foot 22. The feed dogs, loopers and other operational elements of the machine are not illustrated.

In the disclosed embodiment an edge folder 24 (FIGS. 2–6) of conventional design is positioned upstream of the sewing head for progressively forming a fold in the edge portion of the work piece 28. In other uses of the system an edge folder may not be required, although it is generally anticipated that some type of edge folding guide or apparatus will be provided as a part of the sewing machine.

As illustrated in FIGS. 2–6, a spindle assembly 25 is used in combination with the sewing machine 12 to advance a looped end textile work piece 28 through the sewing machine, with a pair of elongated, rotatable spindles 26 and 27 straddling the horizontal work surface 18 (FIG. 3) of the sewing head 16. Each of spindles 26 and 27 are elongate and extend parallel to one another. Spindles 26,27 define a processing path 31 across the horizontal work surface 18 and beneath sewing needles 20 of the sewing head 16. In this embodiment of the invention, a first or idler spindle 27 is positioned upstream of the sewing head 16 and is rotatably supported in a fixed position along processing path 31 so that the spindle rotates, but does not otherwise change position relative to sewing head 16. The downstream or driven spindle 26 is formed as a part of a tension adjustment spindle assembly 30 (FIG. 1), and is movable in position along at least a portion of the processing path 31. As shown in FIGS. 2–6, spindle 26 is positioned downstream of sewing head 16.

Tension adjustment spindle assembly 30 includes a support platform 32 that is mounted on work platform 14, elongated positioning rack 34 that is mounted in a stationary position on support platform 32 and which has a length that extends generally parallel to the processing path 31 of the work piece through the sewing head 16, slide bar 36 that extends parallel to positioning rack 34, stationary spindle support 38 that is slidably mounted to the slide bar 36 and is releasably attached in a stationary position to the positioning rack 34, and spindle mount assembly 40 that slidably supports spindle 26 on the slide bar 36. As will become apparent, the stationary spindle support 38 functions as a spindle support for establishing the range of movement of the spindle mount assembly along the slide bar 36 and rack 34.

Stationary spindle support 38 of tension adjustment spindle assembly 30 includes a bearing 42 that is slidably mounted on slide bar 36, so that it is movable along the length of the slide bar 36, a platform 44 that is rigidly mounted to the bearing 42, and a frame 46 that is rigidly mounted to the bottom surface of platform 44, and is movable with platform 44 along the slide bar.

Pneumatic locking cylinder 48 is mounted to the platform 44 of the stationary spindle support 38, and has a piston rod (not shown) that projects downwardly through the platform, with the distal end of the piston rod supporting a toothed gear segment (not shown) that engages the positioning rack 34. A coil compression spring (not shown) in cylinder 48 urges the toothed gear segment into engagement with rack 34 so as to lock the stationary spindle support 38 in a fixed position along the rack 34.

Valve/handle 50 is also mounted to platform 44, with a valve actuator button 52 positioned so as to be actuated by a finger, typically the thumb, of a machine operator when the hand of the operator surrounds or otherwise grasps valve/handle 50. By depressing actuator button 52, pneumatic pressure is charged to cylinder 48 to lift the gear segment out of engagement with the positioning rack 34, thereby allowing the stationary spindle support 38 and spindle 26 to move along the slide bar toward and away from the sewing head 16. When the finger pressure or pushing force is released from the valve actuator button 52, the air pressure within the cylinder is discharged and the internal spring (not shown) of the hydraulic cylinder 48 urges the gear segment back into locked engagement with the positioning rack 34 to relock the stationary spindle support 38 and spindle 26 to the positioning rack 34.

The frame 46 of stationary spindle support 38 extends beneath spindle mount assembly 40 and is rigidly connected to the spindle mount assembly, so that the spindle mount assembly and all of its elements will slide along the slide bar 36, in the manner as described above. Spindle mount assembly 40 includes vertical support plate 54 that is movably mounted to frame 46, and which in turn supports the spindle 26 in the position as illustrated, spindle drive motor 56 which includes a driving gear (not shown) that engages and rotates the driven gear (not shown) of the spindle 26, and clamp roller assembly 58. Clamp roller assembly 58 includes a roller 60 mounted on the distal end of lever 62 with the lever being pivotally mounted to vertical support plate 54, and pneumatic cylinder 64 which causes lever 62 and its roller 60 to move toward and away from engagement with spindle 26.

Horizontal pneumatic cylinder 66 is interconnected between frame 46 and vertical support plate 54, and functions as a spindle shifting means to slide vertical support plate 54 as well as spindle 26 and clamp roller assembly 58 in unison along the slide bar 36 toward and away from frame 46, and sewing head 16, respectively, decrease and increase the spacing or distance between the spindles 26 and 27. Vertical support plate 54 is slidably mounted on slide bar 36 in a manner similar to the slidable arrangement of stationary spindle support 38 on slide bar 36.

The tension adjustment spindle assembly 30 also includes a tension roller 70 mounted to the distal end of an elongate tension arm 72. Tension arm 72 is pivotally mounted at its other or proximal end to vertical support plate 54 at a pivot point 74 (FIGS. 2–6). A pneumatic cylinder 76 (FIG. 2) is mounted to vertical support plate 54 at a point spaced from pivot point 74, and is connected to the proximal end of tension arm 72 so as to move tension roller 70 in an arc 75 about pivot point 74, as illustrated generally in FIGS. 2 and 3.

So constructed, i.e., by being fastened to and carried on vertical support plate 54, tension arm 72 and tension roller 70, as well as spindle 26, are all movable in unison toward and away from the sewing head 16, with spindle 26 being constructed to be moved in close proximity to the sewing head so that relatively small looped textile work pieces can be processed by the sewing system. Indeed, spindle 26 is movable to a position closely adjacent the horizontal work surface 18 of the sewing head to facilitate the placement of small sized looped work pieces about the spindles, as shown in FIG. 2.

Although not illustrated in greater detail in the drawings, it is anticipated that cylinder 76 of tension adjustment spindle assembly 30 will be a low friction air cylinder such that the piston (not illustrated) within the cylinder can be easily moved in both directions of travel within the cylinder. So constructed, as drive spindle 26 is moved farther away from idler spindle 27 to tension the work piece prior to the start of the machine operating cycle, described more fully below, and as tension roller 70 becomes engaged on return run 29 of workpiece 28, the construction of the air cylinder will allow both the tension roller and the tension arm to move upwardly, as illustrated in FIGS. 4 and 5, with relative ease and without a great deal of internal resistance within cylinder 76 to avoid further stretching of the workpiece. This in turn allows for a constant tension to be maintained in the workpiece during the cycle of operation, as described hereinbelow.

A precision air pressure regulator (not illustrated), and a precision air pressure gauge or air pressure monitoring and signaling device (not illustrated) constructed to monitor and signal the air pressure within cylinder 76 to the machine operator, or and if desired, to a centralized control processor provided as a part of the sewing system/machine, for example a pre-programmed microprocessor, are also provided as a part of the tension adjustment spindle assembly. These components will typically be mounted on the frame of the sewing machine, rather than on support plate 54, although they may be mounted on the support plate if so desired. During the operation of the machine, the air pressure gauge or other data signaling device used with cylinder 76 will indicate the air pressure, and thus tension force, within cylinder 76 so that a constant, and predetermined, tension force is applied by the cylinder to tension arm 74, and in turn to tension roller 70 on return run 29 of the workpiece, or by the work piece to the tension roller, arm and cylinder.

For example, at the start of machine operation, the tension force of the work piece may be measured by the air pressure reading of cylinder 76, as indicated by the air pressure gauge, as the two spindles are moved apart. When spindles 26,27 are moved apart at the start of operations, tension roller 70 and thus tension arm 74 will be moved upwardly by the workpiece, and will in turn move the piston (not illustrated) within cylinder 76 backwards, as shown generally in FIGS. 3–5. As cylinder 76 is a low friction air cylinder, this is accomplished with relative ease and imparts a minimal force to the work piece to avoid undue stretching thereof. If however, the work piece has "grown" or stretched as it invariably will, then the air pressure within cylinder 76, set at the predetermined tension force to be maintained by the tension roller, forces the piston forwardly, and hence the tension arm 74 downwardly, and moves tension roller 70 against the return run of the work piece and thus applies the desired and predetermined tension force to the return run of the workpiece.

OPERATION

Typically, the sewing system 10 is utilized to form a folded hem in the looped waist edge of a tubular textile work piece, such as a knitted sports shirt. If the machine operator is about to process a larger or smaller work piece than the previous work piece processed through the system, the operator will likely depress actuator button 52 of valve/handle 50 so as to release stationary spindle support 38 from the positioning rack 34. The operator then manually moves the entire tension adjustment spindle assembly 30 along the slide bar 36 farther away from, or closer to, the sewing head 16 so that the tension adjustment spindle 26 will be in the correct position to apply the proper tension to the work piece 28 and to properly advance the work piece through the sewing machine.

When the machine is still at rest, before the work piece is mounted on the spindles and before the sewing cycle starts, the presser roller 60 (FIG. 1) is tilted to its up or open position by its pneumatic cylinder 64 so that it is out of the way and the work piece can be easily passed over and placed onto spindle 26. Likewise, tension roller 70 (FIG. 2) is lifted by its tension arm 72 and pneumatic cylinder 76 to a position that is generally between spindles 26 and 27 (FIG. 2) so that the tension roller 70 is out of the way during the workpiece loading process. Further, pneumatic cylinder 66 of spindle mount assembly 40 will have placed the tension adjustment spindle 26 closely adjacent the sewing head (FIG. 2), so that there is a shorter distance between spindles 26 and 27. Then, the machine operator will telescopically insert the waist edge of the garment over and about both spindles 26 and 27, with the edge portion of the shirt placed across the horizontal work surface 18 of the sewing head and beneath the presser foot 22.

When the operator places the waist edge of the knitted shirt in the proper position about spindles 26 and 27, with the edge portion of the work piece 28 being positioned beneath the presser foot 22, a photocell (not shown) detects the presence of the edge portion of the work piece and initiates a cycle of operation of the system. As illustrated in FIG. 3, the tension arm 72 and tension roller 70 are lowered by the application of a predetermined pneumatic pressure to cylinder 76, so that the tension roller 70 moves downwardly into engagement with the lower run 29 of the work piece 28. In the meantime, horizontal cylinder 66 (FIG. 1) begins to move vertical support plate 54 which carries tension adjustment spindle 26 and tension roller 70 away from the sewing head 16, as indicated by arrow 86. As the tension adjustment spindle 26 moves away from the sewing head, it tends to stretch the work piece 28, so that the bottom run 29 of the work piece rises and lifts tension roller 70 and its tension arm 72.

When the tension has been increased in the work piece 28 to the desired value, i.e., when the tension force of the work piece due to spindle separation approximately equals the predetermined tension force within air cylinder 76, tension roller 70 and its tension arm 72 will have been raised high enough so that the tension arm 72 moves into the vicinity of proximity switch 88 (FIG. 5). The actuation of proximity switch 88 causes clamp roller 60 (FIG. 1) to move toward engagement with tension adjustment spindle 26 and spindle drive motor 56 is activated, which begins the rotation of spindle 26, which in turn advances the work piece 28 along the processing path 31 across the sewing station. In some instances, the sewing operation will begin immediately upon the beginning of the advancement of the work piece through the sewing station. In some other situations, where a fold in the work piece is to be created by folder 24 before the sewing function starts, for example, during the loading of the work piece onto the machine, the sewing function will be delayed until the pre-sew portion of the cycle of operation has been performed and the fold in the work piece has been properly created.

In the embodiment illustrated herein which uses an edge folder 24, a pre-sew portion of the cycle is used to establish the fold in the work piece. After the fold in the work piece has been established during the pre-sew phase of the cycle of operation, the sewing function will commence.

As the sewing function continues, the work piece 28 will tend to "grow" or lengthen due to the penetration of needles 20 into and through the work piece, coupled with the placement of stitches of thread between the yarns or filaments of which the work piece is made. As a result of this, and of the work piece to "grow," the tension roller 70 and tension arm 72 will move downwardly under the influence of the force of its pneumatic cylinder 76, so to progressively, gradually and lightly apply a downward tension force against the bottom run 29 of the work piece 28. It is not necessary to shift the tension adjustment spindle 26 farther away from sewing head 16 to compensate for the decreasing tension in the work piece because the predetermined air pressure within air cylinder 76, and thus exerted through tension arm 74 and tension roller 70 to the work piece, compensates for the potential loss of tension in the work piece and maintains a constant tension force on the work piece. This occurs, because the tension force has been predetermined, and has been charged and maintained within cylinder 76, as measured by the appropriate air pressure gauge (not illustrated).

While the foregoing disclosure provides a description of a preferred embodiment of the invention, it should be understood by those skilled in the art that variations and modifications of the invention can be made without departing from the spirit and scope of the invention as set forth in the following claims. In addition, the corresponding structures, materials, acts, and equivalents of all means or step plus function elements in the claims are intended to include any structure, material, or acts for performing the functions in combination with other claimed elements, as specifically claimed herein.

We claim:

1. A spindle assembly for a sewing machine for advancing a looped end textile work piece during a cycle of operation of the sewing machine along a processing path through the sewing machine, the sewing machine having a sewing head and a horizontal work surface, said spindle assembly comprising:

a series of spindles positioned along the processing path for advancing the work piece along the processing path, one of said spindles comprising a tension adjustment spindle for adjusting the tension in the work piece;

a stationary spindle support, said tension adjustment spindle movably mounted to said stationary spindle support;

spindle shifting means connected to said tension adjustment spindle and said stationary spindle support and arranged to move said tension adjustment spindle with respect to said stationary spindle support at the beginning of the cycle of operation of the sewing machine in a direction to apply a predetermined initial tension to the work piece at the beginning of the cycle of operation of the sewing machine; and tension control means for continuously applying and maintaining a predetermined operating tension to the work piece after said spindle shifting means has applied its initial tension to the work piece and as the work piece is advanced along the processing path during the cycle of operation of the sewing machine.

2. A spindle assembly for a sewing machine for advancing a looped end textile work piece during a cycle of operation of the sewing machine along a processing path through the sewing machine, the sewing machine having a sewing head and a work surface, said spindle assembly comprising:

a plurality of spindles positioned along the processing path for advancing the work piece along the processing path, one of said spindles comprising a tension adjustment spindle for adjusting the tension in the work piece movably mounted to a stationary spindle support;

spindle shifting means connected to said tension adjustment spindle and said stationary spindle support and arranged to move said tension adjustment spindle with respect to said stationary spindle support at the beginning of the cycle of operation of the sewing machine in a direction to apply a predetermined initial tension to the work piece;

spindle support position adjustment means adapted to move said spindle support toward or away from the sewing machine, and spindle support locking means for releasably locking said spindle support in a fixed position with respect to said sewing machine; and tension control means for substantially continuously applying a predetermined operating tension to the work piece after said spindle shifting means has applied an initial tension to the work piece as the work piece is advanced along the processing path during the cycle of operation of the sewing machine.

3. A method of applying a predetermined substantially constant tension to a looped end textile work piece as the work piece is advanced along a processing path through and is sewn by a sewing machine, comprising the steps of:

placing the looped end of the work piece about approximately parallel, horizontally extending spindles which straddle the sewing machine and extending the looped end of the work piece through the sewing machine;

moving one of the spindles with respect to the sewing machine in a direction to apply a predetermined amount of initial tension to the looped end of the work piece:

in response to a predetermined initial tension being applied to the looped end of the work piece;

maintaining the movable spindle in a fixed position;

advancing the looped end of the work piece through the sewing machine and about the spindles;

sewing the work piece with the sewing machine through a cycle of operation of the sewing machine; and continuously applying a predetermined force to the looped end of the work piece in a direction to compensate for changes in tension in the work piece and maintain a substantially constant operating tension to the looped end of the work piece during the cycle of operation of the sewing machine.

4. The method of claim 3, and wherein the step of applying a predetermined operating tension to the looped end of the work piece comprises:

applying a tension roller against the looped end of the work piece at a predetermined tension force to maintain said tension force against the looped end of the work piece during the cycle of operation of the sewing machine.

5. A guide system for advancing a looped end of a textile work piece along a processing path through a sewing machine, said guide system including:

spindles positioned along the processing path arranged to advance the looped end of the work piece along the processing path and through the sewing machine;

one of said spindles comprising a tension adjustment spindle for adjusting the tension of the work piece;

a spindle mount, said tension adjustment spindle mounted to said spindle mount;

a stationary spindle support;

spindle shifting means interconnected between said stationary spindle support and said spindle mount for moving said spindle mount and said tension adjustment spindle with respect to said stationary spindle support in a direction to change the length of the processing path and to change the tension in the work piece;

a tension arm having a first end pivotally mounted to said spindle mount and movable with said tension adjustment spindle and having a distal end movable in an arc;

a tension roller rotatably mounted to the distal end of said tension arm in a position for moving into engagement with the work piece and applying tension to the work piece;

biasing means connected to said tension arm for urging said tension roller into engagement with the work piece with a predetermined continuous force; and switch means positioned adjacent said tension arm for determining the position of said tension arm and for terminating the movement of said spindle mount in response to said tension arm moving to a predetermined position.

6. The guide system of claim 5, and further including:

a clamp roller carried by said spindle mount assembly and movable toward engagement with said tension adjustment spindle for urging the work piece into engagement with said tension adjustment spindle.

7. The guide system of claim 5, and further including:

an elongated slide bar extending parallel to the processing path, said stationary spindle support slidably mounted to said slide bar;

an elongated rack extending parallel to said slide bar; and means for releasably locking said stationary spindle support to said rack.

8. The guide system of claim 5, and further including:

a motor mounted on and movable with said spindle mount and operatively connected to said tension adjustment spindle for rotating said tension adjustment spindle.

* * * * *